US012616271B2

(12) United States Patent
Yang et al.

(10) Patent No.: US 12,616,271 B2
(45) Date of Patent: May 5, 2026

(54) CLIMATE CONTROL SYSTEM FOR A SHOE AND RELATED SHOE SOLE

(71) Applicant: Universal Trim Supply Co., Ltd., New Taipei City (TW)

(72) Inventors: Shih-Sheng Yang, Taipei City (TW); Chih-Hung Chen, New Taipei City (TW)

(73) Assignee: Universal Trim Supply Co., Ltd., New Taipei City (TW)

( * ) Notice: Subject to any disclaimer, the term of this patent is extended or adjusted under 35 U.S.C. 154(b) by 0 days.

(21) Appl. No.: 18/602,045

(22) Filed: Mar. 12, 2024

(65) Prior Publication Data

US 2025/0288049 A1 Sep. 18, 2025

(51) Int. Cl.

| | |
|---|---|
| ***A43B 7/00*** | (2006.01) |
| *A43B 7/08* | (2022.01) |
| *A43B 7/083* | (2022.01) |
| *A43B 7/10* | (2022.01) |
| *A43B 13/20* | (2006.01) |

(52) U.S. Cl.

CPC ..... *A43B 7/005* (2013.01); *A43B 7/08* (2013.01); *A43B 7/081* (2013.01); *A43B 7/082* (2013.01); *A43B 7/083* (2022.01); *A43B 7/087* (2013.01); *A43B 7/10* (2013.01); *A43B 13/203* (2013.01); *A43B 13/206* (2013.01)

(58) Field of Classification Search

CPC ..... A43B 7/005; A43B 7/08; A43B 7/081; A43B 7/082; A43B 7/083; A43B 7/10; A43B 7/087; A43B 13/203; A43B 13/206

USPC ..... 36/3 R

See application file for complete search history.

(56) References Cited

U.S. PATENT DOCUMENTS 5,025,575 A * 6/1991 Lakic ..... A43B 13/206 36/44

5,353,525 A * 10/1994 Grim ..... A43B 7/081 36/114

(Continued)

FOREIGN PATENT DOCUMENTS

CN 1064796 A 9/1992

CN 102389180 B 3/2014

(Continued)

*Primary Examiner* — Alissa J Tompkins

*Assistant Examiner* — Dakota Marin

(74) *Attorney, Agent, or Firm* — Winston Hsu

(57) ABSTRACT

A climate control system for a shoe is provided and includes a pumping assembly, a discharge-end assembly and a suction-end assembly. The pumping assembly is formed in a one-piece structure and includes a first layer structure, a second layer structure and a plurality of supporting structures located inside a chamber formed between the first layer structure and the second layer structure and integrally connected between the first layer structure and the second layer structure. When the pumping assembly is forced to be resiliently compressed, air inside the pumping assembly is driven to flow toward the discharge-end assembly and then flow out of the discharge-end assembly to an interior of the shoe through a plurality of ventilation openings. When the pumping assembly is released to resiliently recover, ambient air is driven to flow toward the pumping assembly through the suction-end assembly. Besides, a related shoe sole is also provided.

18 Claims, 6 Drawing Sheets

(56) References Cited

U.S. PATENT DOCUMENTS

| | | | | | |
|---|---|---|---|---|---|
| 5,384,977 | A * | 1/1995 | Chee | A43B 1/0009 | 36/35 B |
| 5,606,806 | A * | 3/1997 | O'Dwyer | A43B 17/08 | 36/3 R |
| 5,845,417 | A * | 12/1998 | Reed | A43B 7/081 | 36/3 R |
| 5,918,383 | A * | 7/1999 | Chee | A43B 13/40 | 36/35 B |
| 6,041,519 | A * | 3/2000 | Cheng | A43B 17/08 | 36/35 B |
| 7,251,907 | B1 * | 8/2007 | Bondarchuk | A43B 17/08 | 36/3 B |
| 7,395,615 | B2 * | 7/2008 | Lee | A43B 13/206 | 36/29 |
| 8,414,275 | B1 * | 4/2013 | Davis | A43B 13/203 | 36/35 B |
| 8,893,403 | B2 * | 11/2014 | Mohlmann | A43B 7/06 | 36/3 R |
| 9,027,262 | B2 * | 5/2015 | Blankenship | A43B 13/206 | 36/3 R |
| 10,420,389 | B2 * | 9/2019 | Audet | A43B 7/081 | |
| 12,150,524 | B2 * | 11/2024 | Chen | A43B 7/087 | |
| 2003/0121175 | A1 * | 7/2003 | Bertolami | A43B 7/081 | 36/3 R |
| 2004/0088882 | A1 * | 5/2004 | Buttigieg | A43B 7/082 | 36/35 B |
| 2005/0005473 | A1 * | 1/2005 | Oh | A43B 7/081 | 36/3 R |
| 2005/0178023 | A1 * | 8/2005 | Hammonds | A43B 7/081 | 36/29 |
| 2016/0029740 | A1 * | 2/2016 | Möhlmann | A43B 13/203 | 36/3 B |
| 2016/0088896 | A1 * | 3/2016 | Acevedo | A43B 7/083 | 36/3 A |
| 2018/0317598 | A1 * | 11/2018 | Möhlmann | A43B 7/085 | |
| 2022/0104582 | A1 * | 4/2022 | Christensen | A43B 13/203 | |

FOREIGN PATENT DOCUMENTS

| | | | |
|---|---|---|---|
| CN | 106937771 | A | 7/2017 |
| CN | 109330090 | A | 2/2019 |
| CN | 209788638 | U | 12/2019 |
| JP | 62-266002 | A | 11/1987 |
| JP | 1-131301 | U | 9/1989 |
| JP | 9-299103 | A | 11/1997 |
| JP | 2000-217604 | A | 8/2000 |
| JP | 2001-258605 | A | 9/2001 |
| JP | 3081968 | U | 11/2001 |
| TW | M405178 | U1 | 6/2011 |
| TW | 201500016 | A | 1/2015 |

* cited by examiner

CLIMATE CONTROL SYSTEM FOR A SHOE AND RELATED SHOE SOLE

BACKGROUND OF THE INVENTION

1. Field of the Invention

The present invention relates a shoe accessory, and more specifically, to a climate control system for a shoe and a related shoe sole.

2. Description of the Prior Art

A shoe sole is an important part which forms a bottom part of a shoe for shock absorption. However, some of the conventional shoe soles may cause discomfort because of poor breathability and poor heat dissipation. Therefore, an improvement is urgently needed.

SUMMARY OF THE INVENTION

It is an objective of the present invention to provide a climate control system for a shoe and a related shoe sole for solving the aforementioned problem.

In order to achieve the aforementioned objective, the present invention discloses a climate control system for a shoe. The climate control system includes a pumping assembly, a discharge-end assembly and a suction-end assembly. The pumping assembly is disposed between an outer sole and an inner sole of a shoe sole of the shoe. The pumping assembly is formed in a one-piece structure and includes a first layer structure, a second layer structure and a plurality of supporting structures. A peripheral portion of the first layer structure and a peripheral portion of the second layer structure are integrally connected to each other, so as to form a chamber between the first layer structure and the second layer structure, and the plurality of supporting structures are located inside the chamber and integrally connected between the first layer structure and the second layer structure. The discharge-end assembly is disposed between the outer sole and the inner sole of the shoe sole of the shoe and communicated with the pumping assembly. The discharge-end assembly includes a plurality of ventilation openings. The suction-end assembly is communicated with the pumping assembly. When the pumping assembly is forced to be resiliently compressed, air inside the pumping assembly is driven to flow toward the discharge-end assembly and then flow out of the discharge-end assembly through the plurality of ventilation openings. When the pumping assembly is released to resiliently recover, ambient air is driven to flow toward the pumping assembly through the suction-end assembly.

According to an embodiment of the present invention, the discharge-end assembly further includes a discharge-end air passage communicated with the plurality of ventilation openings.

According to an embodiment of the present invention, the discharge-end assembly further includes a discharge-end air bag and a non-return valve. The discharge-end air passage and the plurality of ventilation openings are formed on the discharge-end air bag. The non-return valve is disposed between the discharge-end air passage and the pumping assembly and configured to only allow the air inside the pumping assembly to flow toward the discharge-end assembly in one way.

According to an embodiment of the present invention, the suction-end assembly includes a filtering device and a suction-end air passage communicated between the filtering device and the pumping assembly.

According to an embodiment of the present invention, the suction-end assembly further includes a suction-end air bag and a check valve. The suction-end air passage is formed on the suction-end air bag. The check valve is disposed between the suction-end air passage and the pumping assembly and configured to only allow the ambient air to flow toward the pumping assembly through the suction-end assembly in one way.

According to an embodiment of the present invention, the climate control system further includes a three-way fitting communicated among the non-return valve, the check valve and the pumping assembly.

According to an embodiment of the present invention, the suction-end assembly includes a filtering device and a suction-end air passage communicated between the filtering device and the pumping assembly.

According to an embodiment of the present invention, the suction-end assembly further includes a suction-end air bag and a check valve. The suction-end air passage is formed on the suction-end air bag. The check valve is disposed between the suction-end air passage and the pumping assembly and configured to only allow the ambient air to flow toward the pumping assembly through the suction-end assembly in one way.

According to an embodiment of the present invention, each of the plurality of supporting structures is an X-shaped supporting structure.

In order to achieve the aforementioned objective, the present invention further discloses a shoe sole. The shoe sole includes an outer sole, an inner sole and a climate control system. The climate control system includes a pumping assembly, a discharge-end assembly and a suction-end assembly. The pumping assembly is disposed between the outer sole and the inner sole. The pumping assembly is formed in a one-piece structure and includes a first layer structure, a second layer structure and a plurality of supporting structures. A peripheral portion of the first layer structure and a peripheral portion of the second layer structure are integrally connected to each other, so as to form a chamber between the first layer structure and the second layer structure, and the plurality of supporting structures are located inside the chamber and integrally connected between the first layer structure and the second layer structure. The discharge-end assembly is disposed between the outer sole and the inner sole and communicated with the pumping assembly. The discharge-end assembly includes a plurality of ventilation openings. The suction-end assembly is communicated with the pumping assembly. When the pumping assembly is forced to be resiliently compressed, air inside the pumping assembly is driven to flow toward the discharge-end assembly and then flow out of the discharge-end assembly through the plurality of ventilation openings. When the pumping assembly is released to resiliently recover, ambient air is driven to flow toward the pumping assembly through the suction-end assembly.

According to an embodiment of the present invention, the discharge-end assembly further includes a discharge-end air passage communicated with the plurality of ventilation openings.

According to an embodiment of the present invention, the discharge-end assembly further includes a discharge-end air bag and a non-return valve. The discharge-end air passage and the plurality of ventilation openings are formed on the discharge-end air bag. The non-return valve is disposed between the discharge-end air passage and the pumping assembly and configured to only allow the air inside the pumping assembly to flow toward the discharge-end assembly in one way.

According to an embodiment of the present invention, the suction-end assembly includes a filtering device and a suction-end air passage communicated between the filtering device and the pumping assembly.

According to an embodiment of the present invention, the suction-end assembly further includes a suction-end air bag and a check valve. The suction-end air passage is formed on the suction-end air bag. The check valve is disposed between the suction-end air passage and the pumping assembly and configured to only allow the ambient air to flow toward the pumping assembly through the suction-end assembly in one way.

According to an embodiment of the present invention, the climate control system further includes a three-way fitting communicated among the non-return valve, the check valve and the pumping assembly.

According to an embodiment of the present invention, the suction-end assembly includes a filtering device and a suction-end air passage communicated between the filtering device and the pumping assembly.

According to an embodiment of the present invention, the suction-end assembly further includes a suction-end air bag and a check valve. The suction-end air passage is formed on the suction-end air bag. The check valve is disposed between the suction-end air passage and the pumping assembly and configured to only allow the ambient air to flow toward the pumping assembly through the suction-end assembly in one way.

According to an embodiment of the present invention, each of the plurality of supporting structures is an X-shaped supporting structure.

According to an embodiment of the present invention, a plurality of air communication holes are formed on the inner sole and located at positions corresponding to the plurality of ventilation openings.

According to an embodiment of the present invention, a protruding structure is formed on the inner sole and located at a position corresponding to the pumping assembly.

In summary, in the present invention, when the pumping assembly is forced to be resiliently compressed, air inside the pumping assembly is driven to flow toward the discharge-end assembly and then flow out of the discharge-end assembly through the plurality of ventilation openings, and when the pumping assembly is released to resiliently recover, ambient air is driven to flow toward the pumping assembly through the suction-end assembly. Therefore, the present invention can offer an improved heat and moisture dissipating capability to prevent discomfort caused by heat and/or perspiration.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended mean to either an indirect or direct electrical/mechanical connection. Thus, if a first device is coupled to a second device, that connection may be through a direct electrical/mechanical connection, or through an indirect electrical/mechanical connection via other devices and connections.

Figure 1:
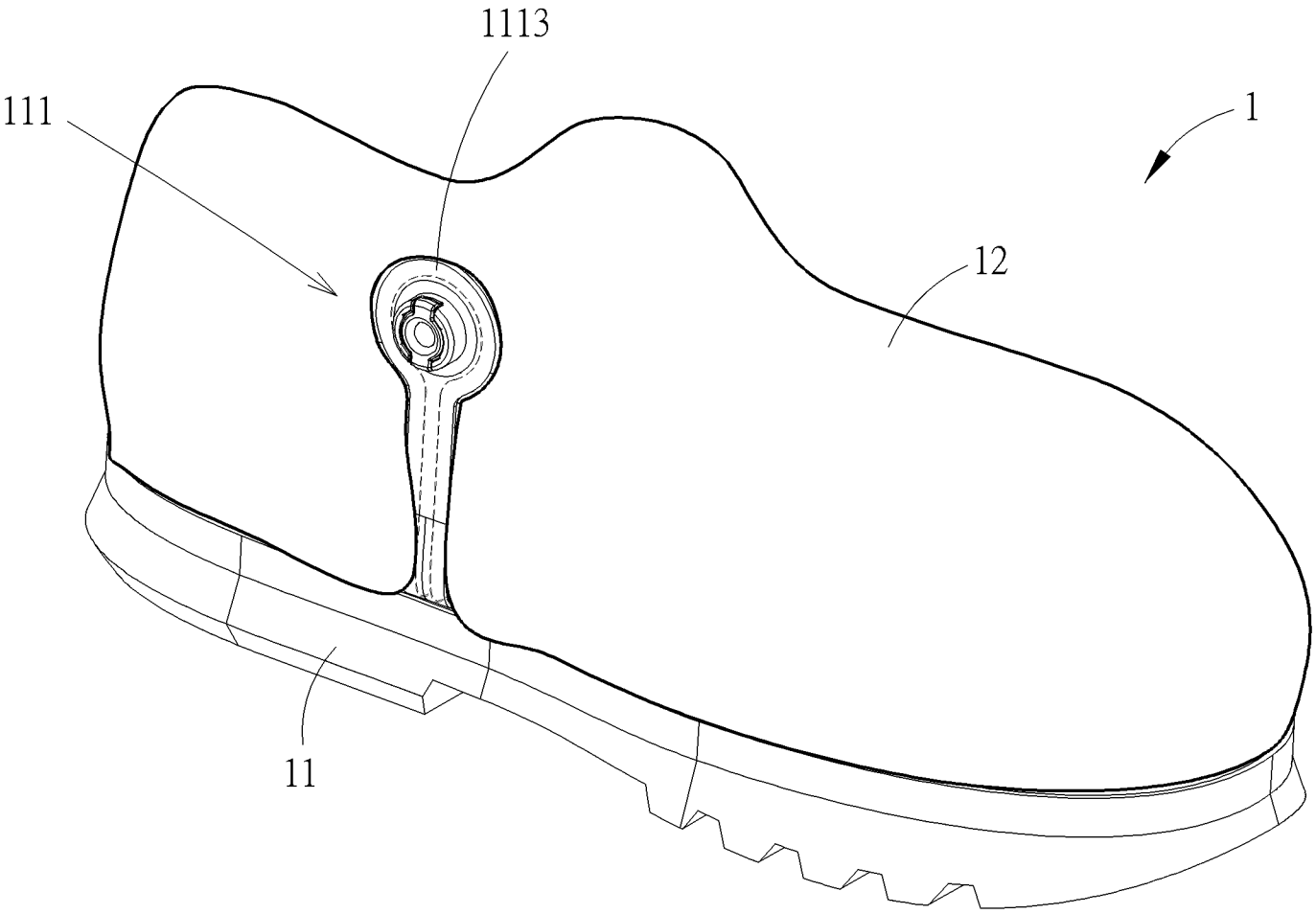
FIG. 1 is a diagram of a shoe according to an embodiment of the present invention.
Figure 2:
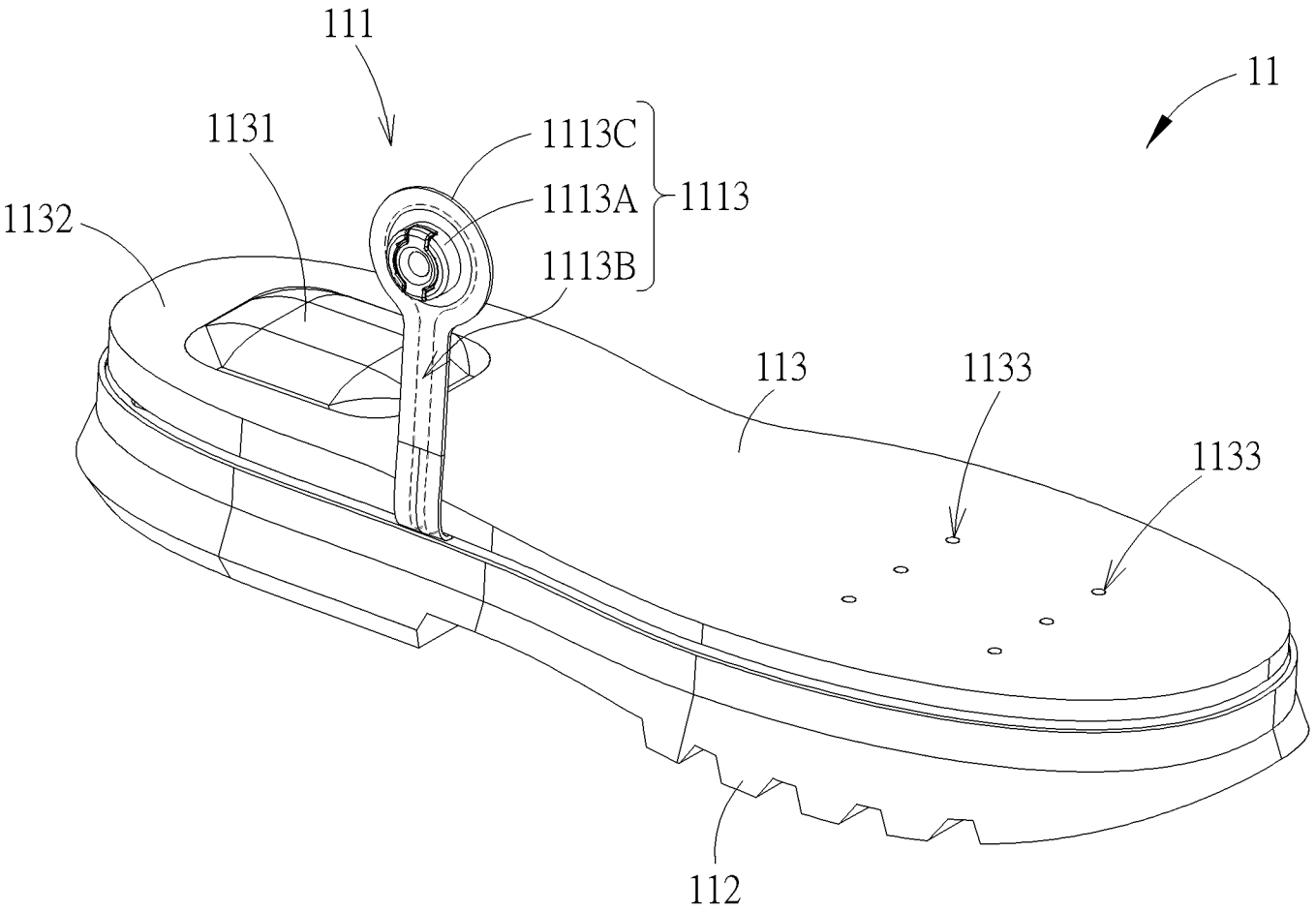
FIG. 2 is a diagram of a shoe sole according to the embodiment of the present invention.
Figure 3:
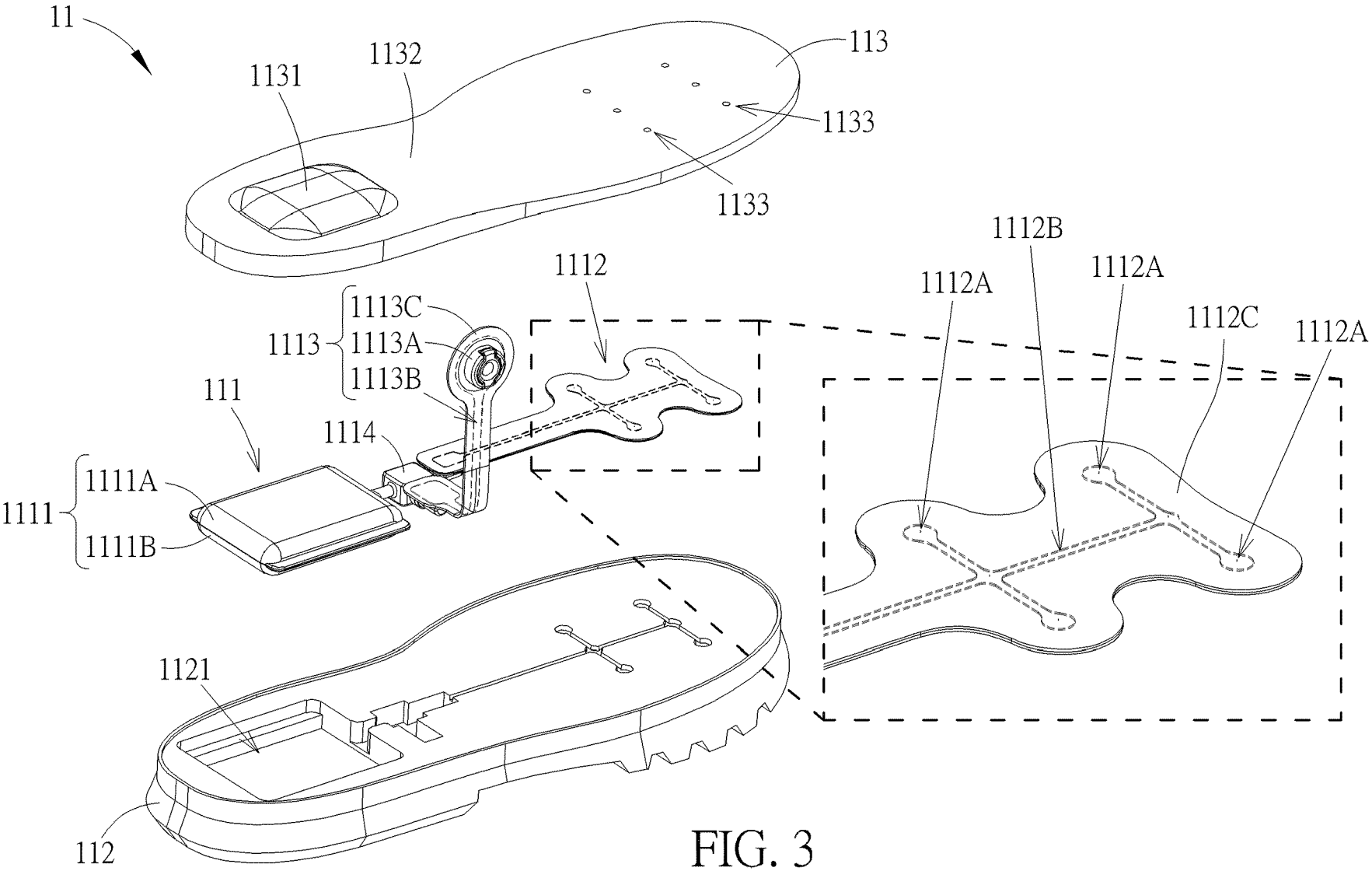
FIG. 3 and FIG. 4 are exploded diagrams of the shoe sole at different views according to the embodiment of the present invention.
Figure 4:
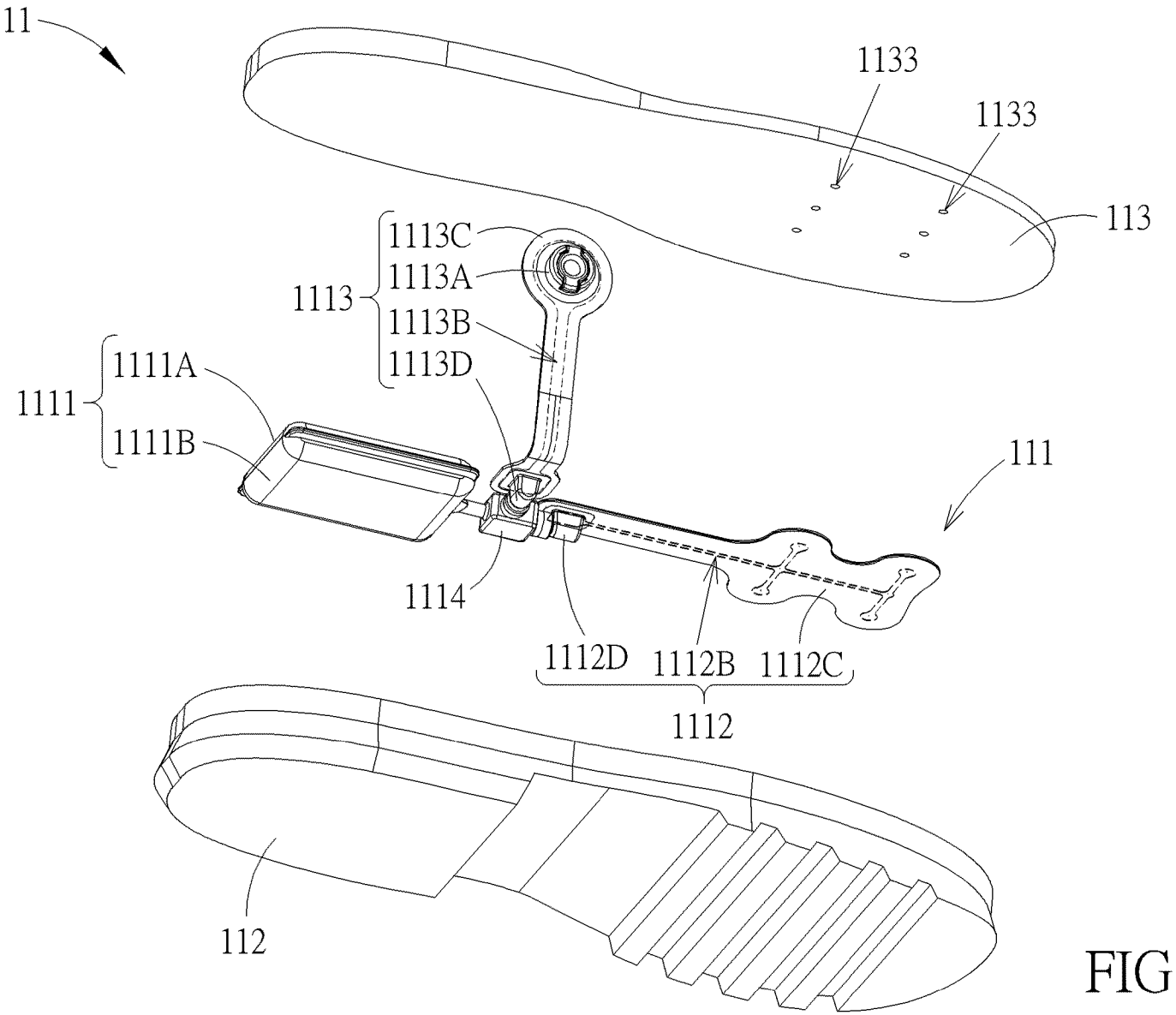
Figure 5:
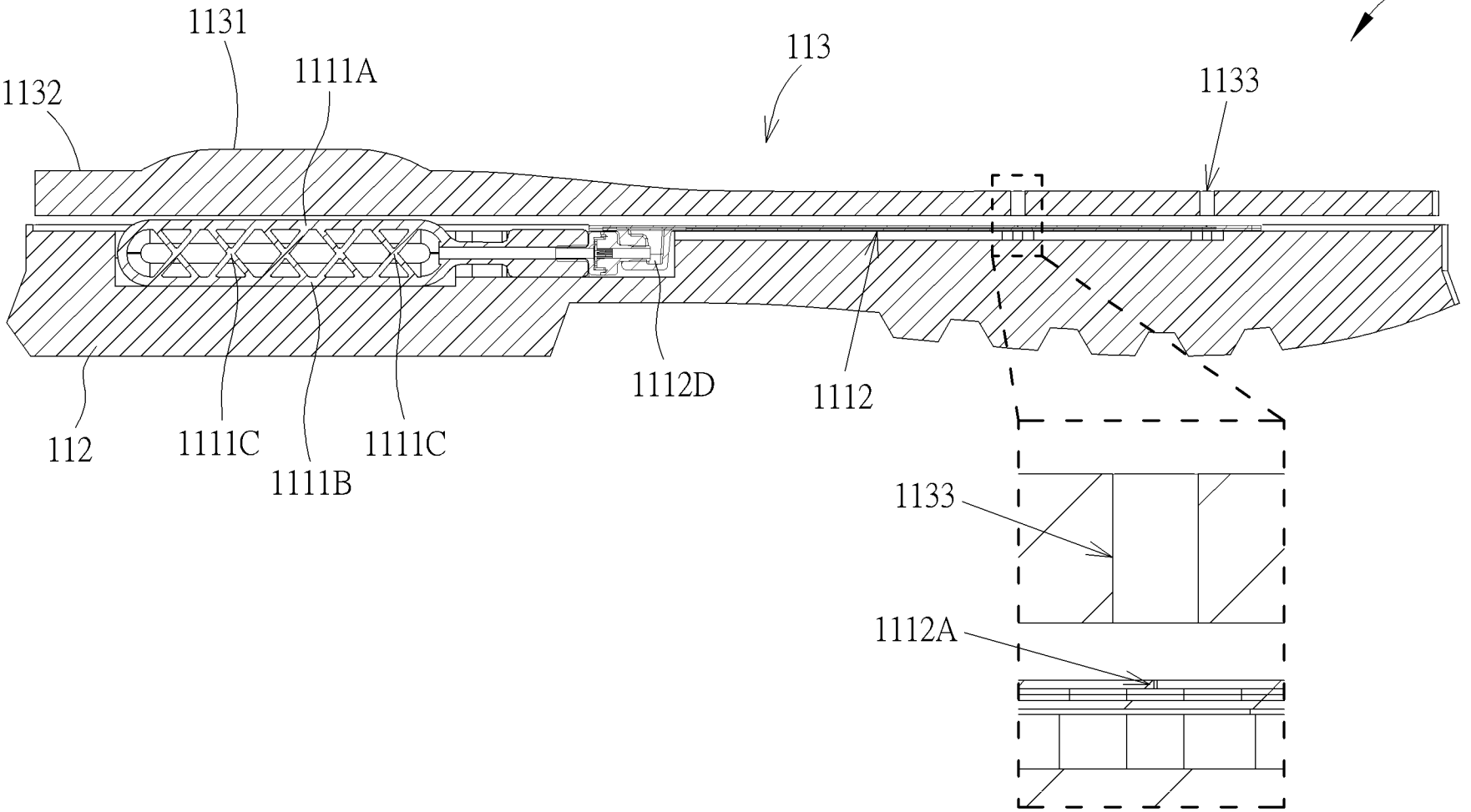
FIG. 5 is a sectional diagram of the shoe sole according to the embodiment of the present invention.
Figure 6:
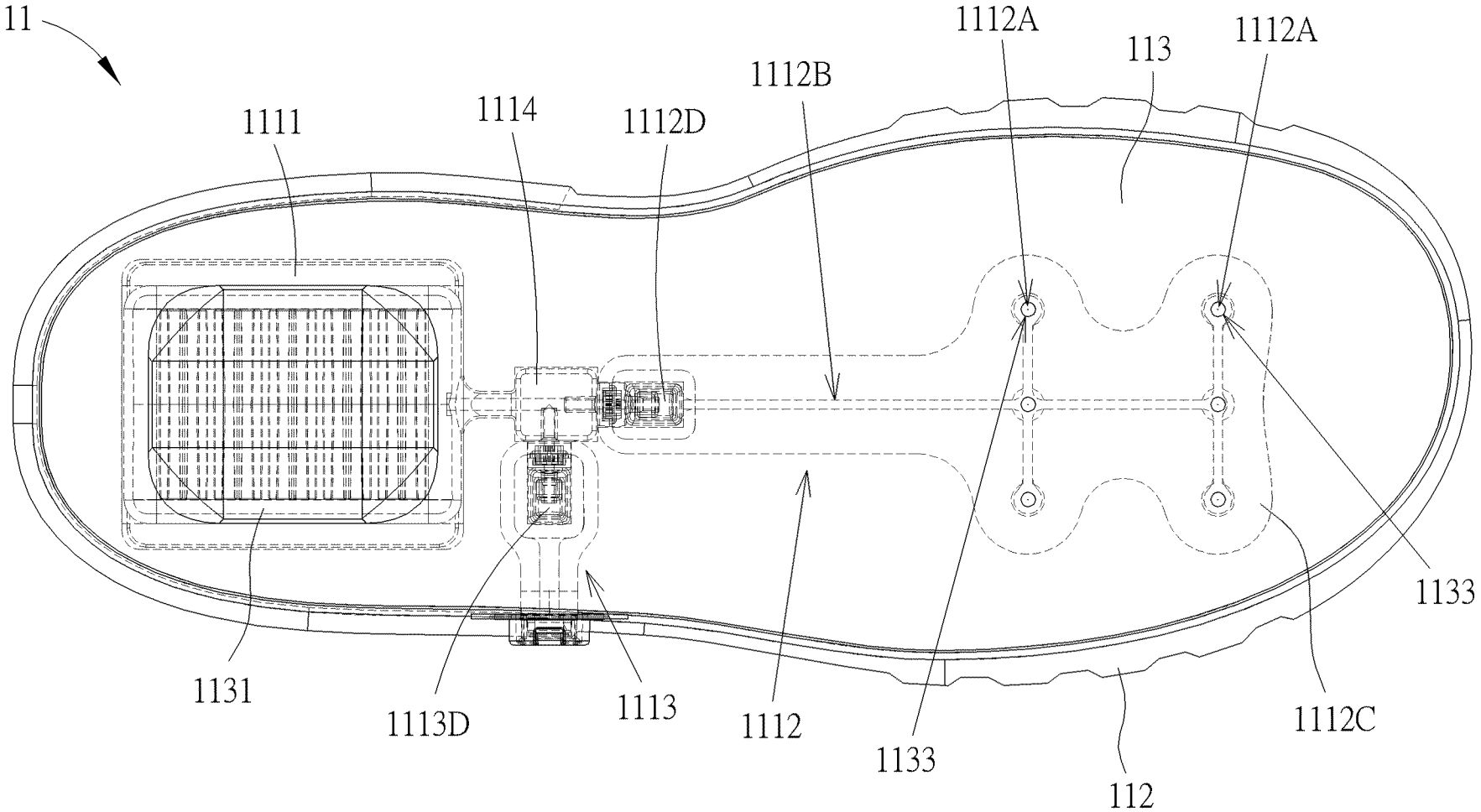
FIG. 6 is a top view diagram of the shoe sole according to the embodiment of the present invention.

Please refer to FIG. 1 to FIG. 6. FIG. 1 is a diagram of a shoe 1 according to an embodiment of the present invention. FIG. 2 is a diagram of a shoe sole 11 according to the embodiment of the present invention. FIG. 3 and FIG. 4 are exploded diagrams of the shoe sole 11 at different views according to the embodiment of the present invention. FIG. 5 is a sectional diagram of the shoe sole 11 according to the embodiment of the present invention. FIG. 6 is a top view diagram of the shoe sole 11 according to the embodiment of the present invention. As shown in FIG. 1, the shoe 1 includes the shoe sole 11 and an upper assembly 12. The shoe sole 11 can be attached onto a bottom portion of the upper assembly 12, and the shoe sole 11 and the upper assembly 12 can cooperatively define an interior space of the shoe 1 for accommodating a foot. The upper assembly 12 is for covering the foot. The shoe sole 11 is for supporting the foot. Furthermore, as shown in FIG. 1 to FIG. 6, the shoe sole 11 includes a climate control system 111, an outer sole 112 and an inner sole 113. The climate control system 111 includes a pumping assembly 1111, a discharge-end assembly 1112 and a suction-end assembly 1113. The pumping assembly 1111 and the discharge-end assembly 1112 are disposed between the outer sole 112 and the inner sole 113 and communicated with the each other. The suction-end assembly 1113 is communicated with the pumping assembly 1111 and partially exposed on an outer surface of the shoe 1. The pumping assembly 1111 is in a resiliently compressible configuration. When the pumping assembly 1111 is forced to be resiliently compressed, air inside the pumping assembly 1111 is driven to flow toward the discharge-end assembly 1112 and then flow out of the discharge-end assembly 1112 to the interior space of the shoe 1. When the pumping assembly 1111 is released to resiliently recover, ambient air is driven to flow toward the pumping assembly 1111 through the suction-end assembly 1113 due to negative pressure inside the pumping assembly 1111. During repeated cycles of resilient deformation and recovery of the pumping assembly 1111, the present invention can keep introducing the ambient air into the interior space of the shoe 1, so as to control a climate surrounding the foot in the shoe 1.

Preferably, as shown in FIG. 3, in this embodiment, a recess 1121 can be formed on the outer sole 112 for at least partially receiving the pumping assembly 1111, the discharge-end assembly 1112 and the suction-end assembly 1113, for positioning the pumping assembly 1111, the discharge-end assembly 1112 and the suction-end assembly 1113.

As shown in FIG. 3 to FIG. 5, in order to achieve cost-effective and structurally and functionally sustainable characteristics of the pumping assembly 1111 for repeated cycles of resilient deformation and recovery, the pumping assembly 1111 is formed in a one-piece structure and can be made of plastic material. The pumping assembly 1111 includes a first layer structure 1111A, a second layer structure 1111B and a plurality of supporting structures 1111C. A peripheral portion of the first layer structure 1111A and a peripheral portion of the second layer structure 1111B are integrally connected to each other, so as to form a chamber between the first layer structure 1111A and the second layer structure 1111B, and the plurality of supporting structures 1111C are located inside the chamber and integrally connected between the first layer structure 1111A and the second layer structure 1111B. Preferably, as shown in FIG. 5, in this embodiment, each of the plurality of supporting structures 1111C is an X-shaped supporting structure.

Furthermore, as shown in FIG. 2, FIG. 3 and FIG. 5, a protruding structure 1131 is formed on the inner sole 113 and located at a position corresponding to the pumping assembly 1111 for effectively transmitting an external force to the pumping assembly 1111, e.g., a stepping force provided by the foot, so as to facilitate resilient deformation of the pumping assembly 1111. Preferably, the protruding structure 1131 can be formed on an upper side 1132 of the inner sole 113 away from the pumping assembly 1111.

As shown in FIG. 3 to FIG. 6, the discharge-end assembly 1112 includes a plurality of ventilation openings 1112A and a discharge-end air passage 1112B. The discharge-end air passage 1112B is communicated with the plurality of ventilation openings 1112A and for allowing the air to flow toward the plurality of ventilation openings 1112A. The plurality of ventilation openings 1112A are for allowing the air to flow out of the discharge-end assembly 1112. In this embodiment, the discharge-end assembly 1112 includes a discharge-end air bag 1112C which can be a multi-layer structure made of plastic material. The discharge-end air passage 1112B and the plurality of ventilation openings 1112A are formed on the discharge-end air bag 1112C. The discharge-end air passage 1112B can be a channel on the discharge-end air bag 1112C, and the ventilation opening 1112A can be a hole on the discharge-end air bag 1112C. However, the present invention is not limited to this embodiment. For example, in another embodiment, the discharge-end assembly can include a discharge-end tube, and the discharge-end air passage and the ventilation opening can be a channel on the discharge-end tube and a hole on the discharge-end tube, respectively.

Preferably, as shown in FIG. 4 to FIG. 6, the discharge-end assembly 1112 further includes a non-return valve 1112D disposed between the discharge-end air passage 1112B and the pumping assembly 1111 and configured to only allow the air inside the pumping assembly 1111 to flow toward the discharge-end assembly 1112 in one way for preventing any backflow.

Besides, as shown in FIG. 2 to FIG. 5, a plurality of air communication holes 1133 are formed on the inner sole 113 and located at positions corresponding to the plurality of ventilation openings 1112A, so as to provide easy access to the interior space of the shoe 1 for the air.

In addition, as shown in FIG. 1 to FIG. 4, the suction-end assembly 1113 includes a filtering device 1113A configured to filter the ambient air, e.g., remove particles or dusts from the ambient air, and a suction-end air passage 1113B communicated between the filtering device 1113A and the pumping assembly 1111. In this embodiment, the suction-end assembly 1113 includes a suction-end air bag 1113C which can be a multi-layer structure made of plastic material. The suction-end air passage 1113B is formed on the suction-end air bag 1113C. The suction-end air passage 1113B can be a channel on the suction-end air bag 1113C. However, the present invention is not limited to this embodiment. For example, in another embodiment, the suction-end assembly can include a suction-end tube, and the suction-end air passage can be a channel on the suction-end tube.

Preferably, as shown in FIG. 4 and FIG. 6, the suction-end assembly 1113 further includes a check valve 1113D disposed between the suction-end air passage 1113B and the pumping assembly 1111 and configured to only allow the ambient air to flow toward the pumping assembly 1111 through the suction-end assembly 1113 in one way for preventing any backflow.

Moreover, as shown in FIG. 3, FIG. 4 and FIG. 6, in order to achieve a connection among the pumping assembly 1111, the discharge-end assembly 1112 and the suction-end assembly 1113, the climate control system 111 further includes a three-way fitting 1114 communicated among the non-return valve 1112D, the check valve 1113D and the pumping assembly 1111.

In contrast to the prior art, in the present invention, when the pumping assembly is forced to be resiliently compressed, the air inside the pumping assembly is driven to flow toward the discharge-end assembly and then flow out of the discharge-end assembly through the plurality of ventilation openings, and when the pumping assembly is released to resiliently recover, the ambient air is driven to flow toward the pumping assembly through the suction-end assembly. Therefore, the present invention can offer an improved heat and moisture dissipating capability to prevent discomfort caused by heat and/or perspiration.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A climate control system for a shoe, the climate control system comprising:

a pumping assembly disposed between an outer sole and an inner sole of a shoe sole of the shoe, the pumping assembly being formed in a one-piece structure and comprising a first layer structure, a second layer structure and a plurality of supporting structures, a peripheral portion of the first layer structure and a peripheral portion of the second layer structure being integrally connected to each other, so as to form a chamber between the first layer structure and the second layer structure, and the plurality of supporting structures being located inside the chamber and integrally connected between the first layer structure and the second layer structure;

a discharge-end assembly disposed between the outer sole and the inner sole of the shoe sole of the shoe and communicated with the pumping assembly, the discharge-end assembly comprising a discharge-end air bag, a plurality of ventilation openings formed on the discharge-end air bag and a discharge-end air passage formed on the discharge-end air bag and communicated with the plurality of ventilation openings, the discharge-end air passage being for allowing air inside the discharge-end assembly to flow toward the plurality of ventilation openings, and the plurality of ventilation openings being for allowing the air inside the discharge-end assembly to flow out of the discharge-end assembly; and a suction-end assembly communicated with the pumping assembly;

wherein when the pumping assembly is forced to be resiliently compressed, air inside the pumping assembly is driven to flow toward the discharge-end assembly and then flow out of the discharge-end assembly through the plurality of ventilation openings;

wherein when the pumping assembly is released to resiliently recover, ambient air is driven to flow toward the pumping assembly through the suction-end assembly.

2. The climate control system of claim 1, wherein the discharge-end assembly further comprises a non-return valve disposed between the discharge-end air passage and the pumping assembly and configured to only allow the air inside the pumping assembly to flow toward the discharge-end assembly in one way.

3. The climate control system of claim 2, wherein the suction-end assembly comprises a filtering device and a suction-end air passage communicated between the filtering device and the pumping assembly.

4. The climate control system of claim 3, wherein the suction-end assembly further comprises a suction-end air bag and a check valve, the suction-end air passage is formed on the suction-end air bag, the check valve is disposed between the suction-end air passage and the pumping assembly and configured to only allow the ambient air to flow toward the pumping assembly through the suction-end assembly in one way.

5. The climate control system of claim 4, further comprising a three-way fitting communicated among the non-return valve, the check valve and the pumping assembly.

6. The climate control system of claim 1, wherein the suction-end assembly comprises a filtering device and a suction-end air passage communicated between the filtering device and the pumping assembly.

7. The climate control system of claim 6, wherein the suction-end assembly further comprises a suction-end air bag and a check valve, the suction-end air passage is formed on the suction-end air bag, the check valve is disposed between the suction-end air passage and the pumping assembly and configured to only allow the ambient air to flow toward the pumping assembly through the suction-end assembly in one way.

8. The climate control system of claim 1, wherein each of the plurality of supporting structures is an X-shaped supporting structure.

9. A shoe sole comprising:

an outer sole;

an inner sole; and a climate control system comprising:

a pumping assembly disposed between the outer sole and the inner sole, the pumping assembly being formed in a one-piece structure and comprising a first layer structure, a second layer structure and a plurality of supporting structures, a peripheral portion of the first layer structure and a peripheral portion of the second layer structure being integrally connected to each other, so as to form a chamber between the first layer structure and the second layer structure, and the plurality of supporting structures being located inside the chamber and integrally connected between the first layer structure and the second layer structure;

a discharge-end assembly disposed between the outer sole and the inner sole and communicated with the pumping assembly, the discharge-end assembly comprising a discharge-end air bag, a plurality of ventilation openings formed on the discharge-end air bag and a discharge-end air passage formed on the discharge-end air bag and communicated with the plurality of ventilation openings, the discharge-end air passage being for allowing air inside the discharge-end assembly to flow toward the plurality of ventilation openings, and the plurality of ventilation openings being for allowing the air inside the discharge-end assembly to flow out of the discharge-end assembly; and a suction-end assembly communicated with the pumping assembly;

wherein when the pumping assembly is forced to be resiliently compressed, air inside the pumping assembly is driven to flow toward the discharge-end assembly and then flow out of the discharge-end assembly through the plurality of ventilation openings;

wherein when the pumping assembly is released to resiliently recover, ambient air is driven to flow toward the pumping assembly through the suction-end assembly.

10. The shoe sole of claim 9, wherein the discharge-end assembly further comprises a non-return valve disposed between the discharge-end air passage and the pumping assembly and configured to only allow the air inside the pumping assembly to flow toward the discharge-end assembly in one way.

11. The shoe sole of claim 10, wherein the suction-end assembly comprises a filtering device and a suction-end air passage communicated between the filtering device and the pumping assembly.

12. The shoe sole of claim 11, wherein the suction-end assembly further comprises a suction-end air bag and a check valve, the suction-end air passage is formed on the suction-end air bag, the check valve is disposed between the suction-end air passage and the pumping assembly and configured to only allow the ambient air to flow toward the pumping assembly through the suction-end assembly in one way.

13. The shoe sole of claim 12, wherein the climate control system further comprises a three-way fitting communicated among the non-return valve, the check valve and the pumping assembly.

14. The shoe sole of claim 9, wherein the suction-end assembly comprises a filtering device and a suction-end air passage communicated between the filtering device and the pumping assembly.

15. The shoe sole of claim 14, wherein the suction-end assembly further comprises a suction-end air bag and a check valve, the suction-end air passage is formed on the suction-end air bag, the check valve is disposed between the suction-end air passage and the pumping assembly and configured to only allow the ambient air to flow toward the pumping assembly through the suction-end assembly in one way.

16. The shoe sole of claim 9, wherein each of the plurality of supporting structures is an X-shaped supporting structure.

17. The shoe sole of claim 9, wherein a plurality of air communication holes are formed on the inner sole and located at positions corresponding to the plurality of ventilation openings.

18. A shoe sole comprising:

an outer sole;

an inner sole; and a climate control system comprising:

a pumping assembly disposed between the outer sole and the inner sole, the pumping assembly being formed in a one-piece structure and comprising a first layer structure, a second layer structure and a plurality of supporting structures, a peripheral portion of the first layer structure and a peripheral portion of the second layer structure being integrally connected to each other, so as to form a chamber between the first layer structure and the second layer structure, and the plurality of supporting structures being located inside the chamber and integrally connected between the first layer structure and the second layer structure;

a discharge-end assembly disposed between the outer sole and the inner sole and communicated with the pumping assembly, the discharge-end assembly comprising a plurality of ventilation openings; and a suction-end assembly communicated with the pumping assembly;

wherein when the pumping assembly is forced to be resiliently compressed, air inside the pumping assembly is driven to flow toward the discharge-end assembly and then flow out of the discharge-end assembly through the plurality of ventilation openings;

wherein when the pumping assembly is released to resiliently recover, ambient air is driven to flow toward the pumping assembly through the suction-end assembly;

wherein a protruding structure is formed on the inner sole and located at a position corresponding to the pumping assembly.

* * * * *